US006411201B1

(12) United States Patent
Hur et al.

(10) Patent No.: US 6,411,201 B1
(45) Date of Patent: Jun. 25, 2002

(54) STROBE ALARM WITH STROBE INTENSITY SELECTOR SWITCH

(75) Inventors: Inhong Hur, Oakhurst; Joseph Kosich, S. Toms River; John W. Curran, Lebanon, all of NJ (US)

(73) Assignee: Wheelock, Inc., Long Branch, NJ (US)

( * ) Notice: Subject to any disclaimer, the term of this patent is extended or adjusted under 35 U.S.C. 154(b) by 0 days.

(21) Appl. No.: 09/449,277

(22) Filed: Nov. 24, 1999

(51) Int. Cl.[7] ..... G08B 23/00
(52) U.S. Cl. ..... 340/332; 340/321; 315/200 A
(58) Field of Search ..... 315/200 A, 240, 315/241 S, 245, 362; 340/332, 321, 326

(56) References Cited

U.S. PATENT DOCUMENTS 3,792,309 A * 2/1974 McDonald ..... 315/200 A

* cited by examiner

*Primary Examiner*—Daryl Pope
(74) *Attorney, Agent, or Firm*—Moser, Patterson & Sheridan, LLP

(57) ABSTRACT

A strobe alarm has a multi-position switch for selecting a predetermined strobe intensity. The strobe alarm comprises a strobe assembly having selector switch, an indicator and a menu. The selector switch is positioned within the strobe alarm to discourage tampering. The indicator and menu are positioned in plain view for easy determination of the intensity setting of the strobe alarm.

23 Claims, 7 Drawing Sheets

STROBE ALARM WITH STROBE INTENSITY SELECTOR SWITCH

BACKGROUND OF THE DISCLOSURE

1. Field of Invention

The invention relates generally to an alarm system for providing visual warnings and, more particularly, to a strobe alarm having a selectable strobe intensity.

2. Background of Invention

Signaling devices, such as strobe lights, are used to provide warning of potential hazards or to draw attention to an event or activity. An important field of use for these strobe lights is in electronic fire alarm systems. Strobe alarms typically include a flashtube and a trigger circuit for initiating firing of the flashtube. The energy for the flash is typically supplied from a capacitor connected in shunt with the flashtube. In some systems, the flash occurs when the voltage across the flash unit (i.e., the flashtube and associated trigger circuit) exceeds the threshold voltage required to actuate the trigger circuit, and in others the flash is triggered by a timing circuit. After the flashtube is triggered, it becomes conductive and rapidly discharges the stored energy from the shunt capacitor until the voltage across the flashtube has decreased to a value at which the flashtube is extinguished and becomes non-conductive.

As with most safety devices, the performance and installation of strobe alarms (including those strobe alarms equipped with an audio warning) are generally governed by federal, state and municipal regulations which require conformance to an Underwriters Laboratory (UL®) specification. For example, UL 1971 specifies that strobe alarms to have certain candela outputs when installed in various locations, e.g., ceilings, walls and the like. In order to comply with regulatory requirements, manufacturers offer strobe alarms in different candela intensities, e.g., 15, 30, 75 and 110 candela, in order to meet the full range regulatory intensity requirements.

Additionally, the intensity of the strobe alarm is required to be visible on the installed strobe alarms in a location accessible to an observer. Generally, this requirement is met by labeling the strobe alarm in a tamper-proof location. Alternately, a component, such as the reflector, is stamped or embossed to indicate the strobe intensity.

In order to meet these varied requirements, manufactures of strobe alarms have responded by producing multiple models of strobe alarms, each having a designated intensity. Since the intensity of each strobe alarm is controlled by a specific circuit configuration, a unique circuit board is normally utilized on each model. Additionally, the use of tamper-proof labeling wherein the components are embossed to indicate the candela output, prevents uses of those components on strobe alarms having intensities different than the embossed intensity value. Additionally, maintaining different production lines for the manufacture of strobe alarms having different predetermined candela intensities requires factory capacity to be apportioned among the each candela model. Furthermore, the stocking of components that are used in different models requires costly warehouse space and increases the likelihood of shipment errors.

Therefore, there is a need in the art for a strobe alarm that has a strobe intensity that is selectable from a predetermined range, i.e., a multi-candela strobe alarm. Such a strobe alarm should also comprise an indicator of the selected intensity that is visible to inspection while offering tamper-protection of the intensity setting.

SUMMARY OF INVENTION

The disadvantages associated with the prior art are overcome by the present invention of a strobe alarm that provides a selectable intensity setting. The inventive strobe alarm comprises a strobe assembly having a menu, a selector switch, and an actuator. The actuator engages the selector switch so that lateral movement of the actuator is translated to the selector switch. The actuator additionally points to the menu selection that corresponds to an intensity setting of the selector switch.

The actuator and the menu are positioned to readily denote the strobe intensity setting to an observer. The actuator is positioned within the strobe alarm so that it is easily adjusted upon installation but cannot be adjusted without removal of the housing, thus discouraging tampering.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAIL DESCRIPTION OF INVENTION

The present invention of a strobe alarm having a selectable strobe intensity is described below in an exemplary embodiment of a visual warning device. However, alternate embodiments of other warning devices comprising a strobe alarm can be readily devised by those skilled in the art while incorporating the teachings disclosed herein. For example, the strobe alarm can be augmented with an audio warning device, such as a speaker, buzzer, horn, bell or voice signal. Thus, the specification should not be read as limiting the invention of the exemplary strobe alarm described below, but to encompass alarms comprising strobe alarms having selectable intensities including those complemented by other warning devices.

Figure 1:
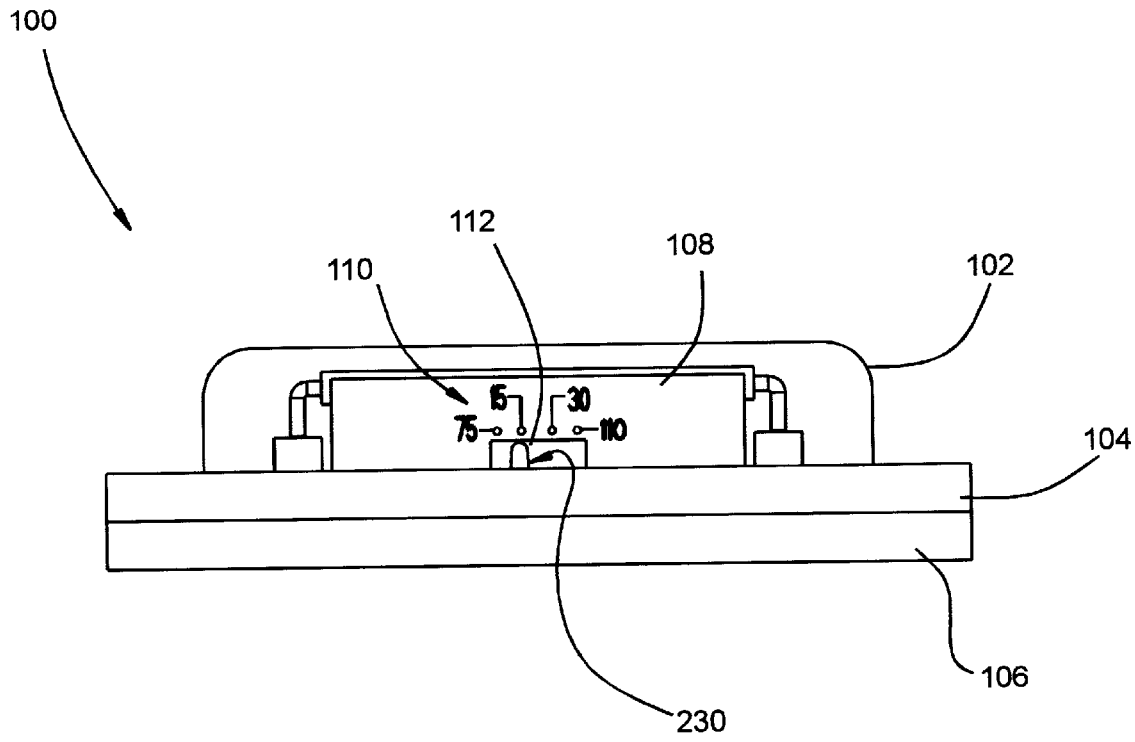
FIG. 1 is a plan view of a strobe alarm of the present invention.

FIG. 1 depicts an exemplary embodiment of a strobe alarm 100 having a lens 102, a cover 104, a mounting plate 106 and a strobe assembly 108. The strobe assembly 108 comprises an actuator 230 having an indicating needle 112 that points to a setting menu 110 to identify the intensity setting for the strobe alarm 100. The actuator 230 engages a selector switch describe further below which sets the strobe intensity. The indicating needle 112 of the actuator 230 is open to inspection, i.e., is in plan view, through the lens 102 enabling an observer to easily identify the intensity setting of the strobe alarm 110.

Figure 2:
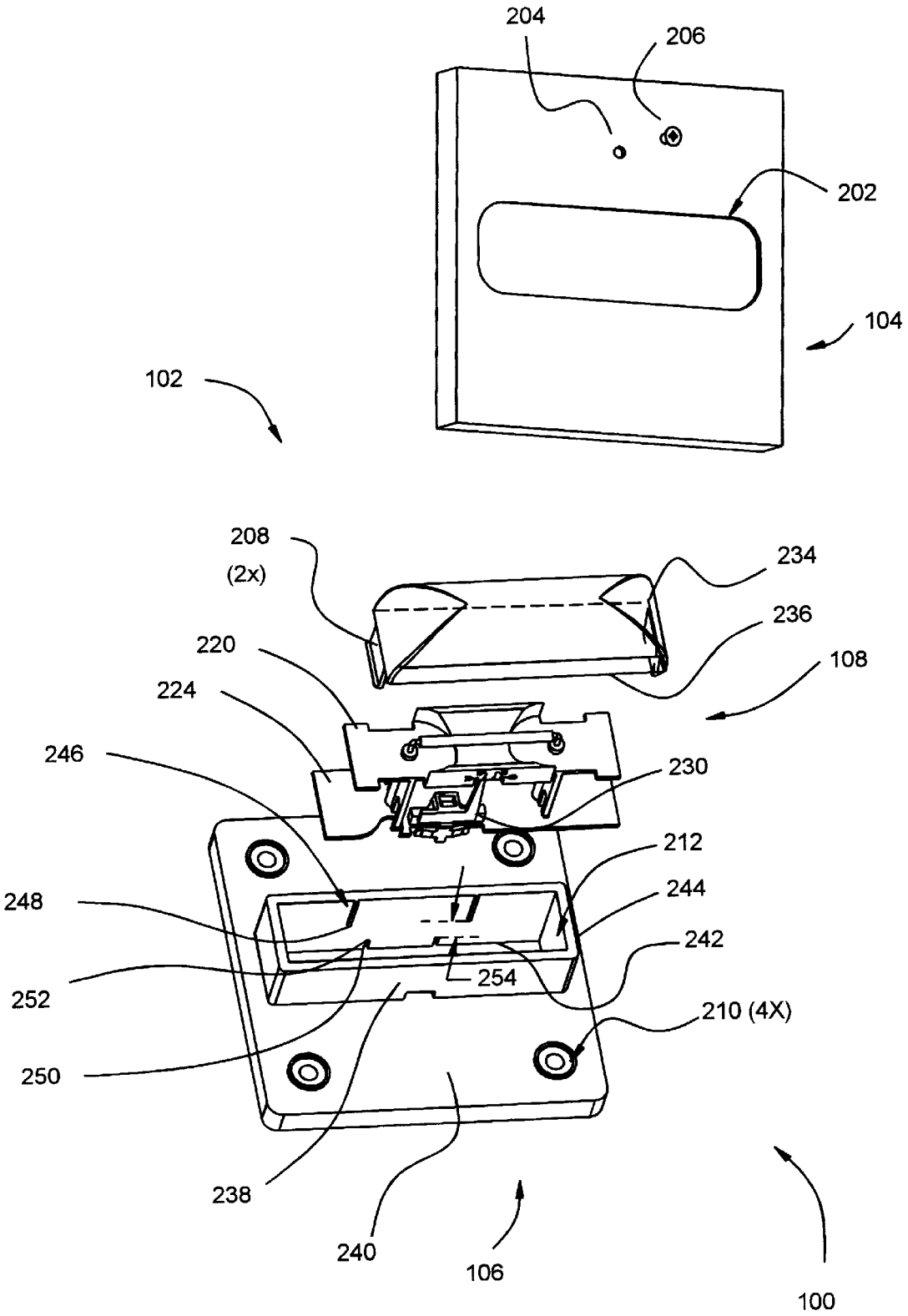
FIG. 2 is an exploded view of the strobe alarm of FIG. 1.

FIG. 2 depicts an exploded view of the strobe alarm 100 of FIG. 1. The lens 102 is fabricated from a transparent material such as optical quality acrylic or other optical quality plastic. The lens 102 has a rectangular perimeter 236 having a domed shaped center 234. Alternate lens shapes may be optionally utilized. The domed shaped center 234 accommodates at least a portion of the strobe assembly 108 within the lens 102. The lens 102 has opposing latches 208 on the short sides of the rectangular perimeter 236. The opposing latches 208 engage the mounting plate 106 to retain the lens 102. Optionally, the lens 102 may be retained by alternate fastening methods, examples of which are interference fit, solvent bonding, adhesives, screws and rivet fasteners.

The cover 104 is generally a polygonal shell, although other shapes may optionally be utilized. The cover 104 has an aperture 202 configured to allow the lens 102 to pass through with minimal clearance, allowing the lens to project outwards beyond the cover 104. The cover 104 has one or more holes 204 that allow the cover 104 to be secured to the mounting plate 106 by a screw 206. Alternately, the cover 104 may be removably affixed to the mounting plate 106 by other means, for example, mating thread forms, screws, rivets, snap-fits, and quarter-turn fastening.

The mounting plate 106 has generally a polygonal base plate 240, and configured to accept the cover 104. The base plate 240 has a plurality of mounting holes 210 that facilitate securing the mounting plate 106 to a backbox typically fixed to a surface, such as a wall of a building (backbox and wall not shown). The mounting plate 106 additionally comprises a generally elongated, rectangular, outstanding base 238 extending from the base plate 240 that defines a central conduit 212.

The rectangular outstanding base 238 has an open end 242 and a terminal end 244. The terminal end 244 is configured to mate with the perimeter 236 of the lens 102, while allowing the latches 208 to pass into the outstanding base 238 and engage the mounting plate 106, thus retaining the lens 102. The outstanding base 238 comprises a plurality of ribs 246 protruding into the central conduit 212 and orientated co-axially in relation to the outstanding base 238. Each rib 246 runs from the terminal end 244 of the outstanding base 238 and ends in a land 248 spaced apart from the open end 242. The land 248 is substantially perpendicular in relation to the outstanding base 238. The outstanding base 238 additionally comprises a plurality of wedges 250 protruding into the central conduit 212 and orientated co-axially to the outstanding base 238. The wedges 250 are angled into the central conduit 212 from the open end 242, forming a ledge 252. The ledge 252 of the wedge 250 is positioned closer to the open end 242 than the land 248, thus defining a gap 254 in a plane parallel to the plane of the base plate 240. The central conduit 212 permits passage of communication and/or power conductors (i.e., wires not shown) coupled to the strobe assembly 108. Optionally, a terminal block (not shown) is disposed proximate the central conduit 212 to facilitate electric connections between the conductors passing through the central conduit 212 and the strobe assembly 108. One example of a mounting plate 106 is disclosed in U.S. Pat. No. 5,805,071, issued Sep. 8, 1998, to Inhong Hur, and is hereby incorporated by reference.

The strobe assembly 108 comprises a reflector 220, a base 224 and the actuator 230. The strobe assembly 108 is disposed within the outstanding boss 238 of the mounting plate 106 with at least a portion of the reflector 220 protruding into the lens 102. The strobe assembly 108 is fixed in the boss by snapping the base into the gap defined between the wedge and lands. Alternately, the strobe assembly 108 may be fixed in this position through a number of means including screwing, riveting, staking or adhering the strobe assembly 108 to the mounting plate 106. Upon assembly of the strobe alarm 100, the strobe assembly 108 including the indicator 112 is encased by the cover 104 and/or lens 102.

Figure 3:
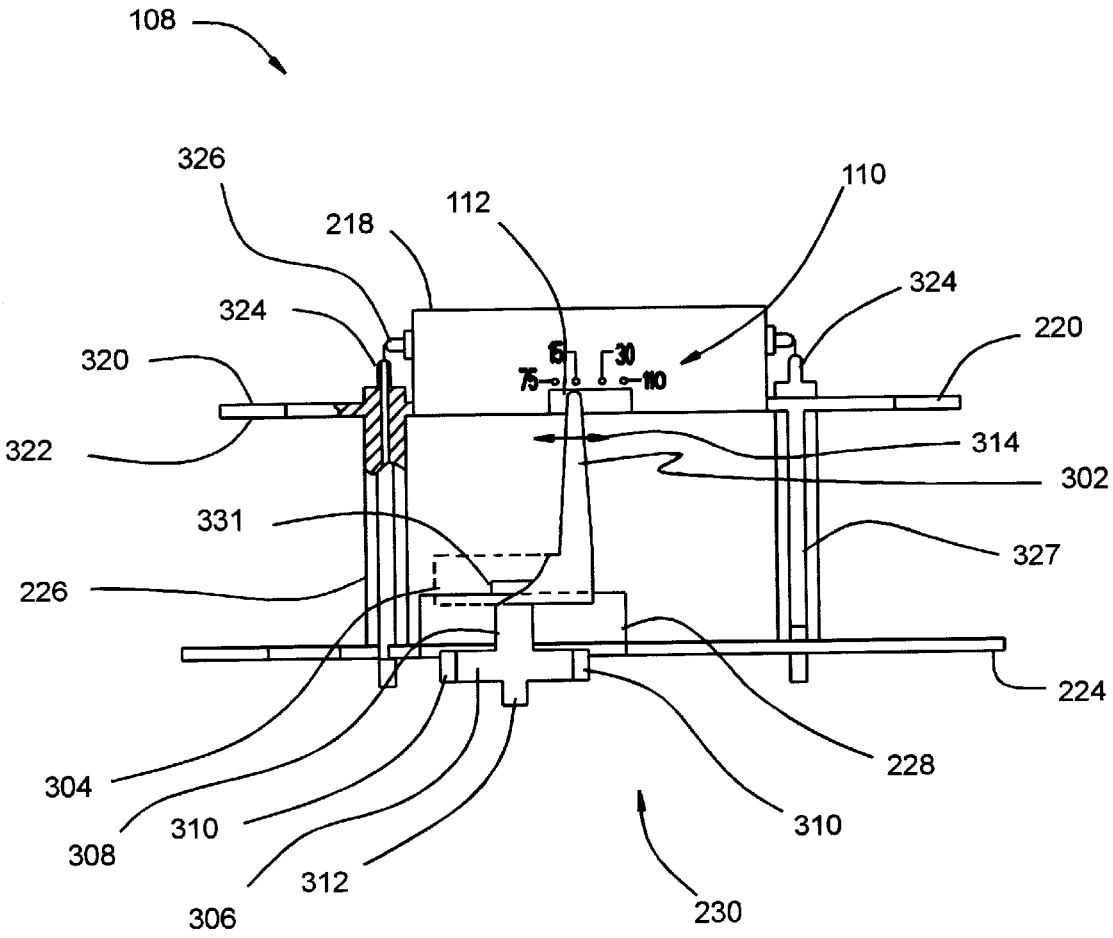
FIG. 3 is a simplified elevation of a strobe assembly of the strobe alarm of FIG. 1.
Figure 4:
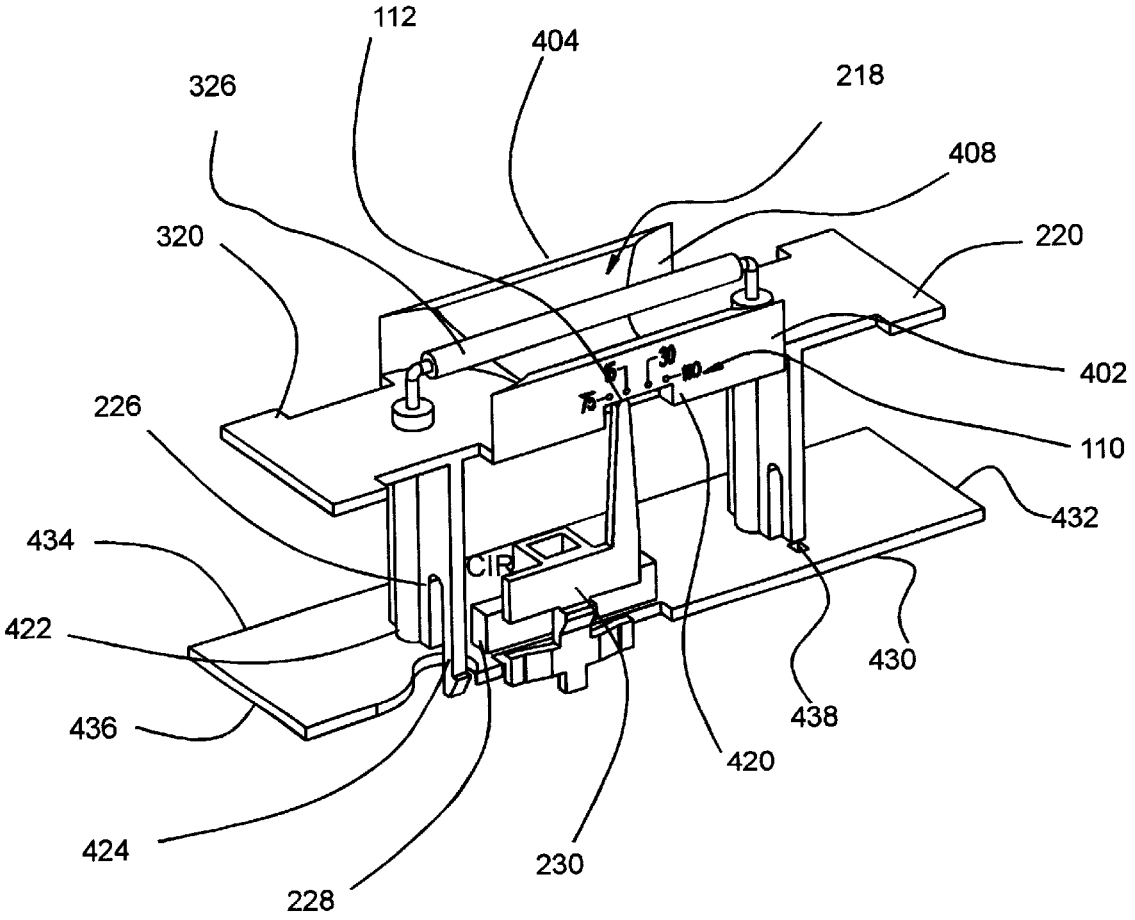
FIG. 4 is an isometric view of the strobe assembly of FIG. 3.

FIG. 3 and FIG. 4 describe the strobe assembly 108 in greater detail. The strobe assembly 108 comprises an actuator 230, a reflector 220 and a base 224. The reflector 220 is held in a fixed position relative to the base 224 by one or more standoff's 226. The reflector 220 has a first surface 320, a second surface 322, and a center portion 218. The first surface 320 contains two receptors 324 positioned one to each side of the center portion 218 to accommodate a light emitting element, i.e., a strobe lamp 326. The center portion 218 has a reflective concave surface 408 that partially surrounds the strobe lamp 326. A first side 402 and a second side 404 of the center portion 218 connect the concave surface 408 to the first surface 320. The geometry of the concave surface 408 can vary as desired to satisfy the requirements of the intended use and as such, an infinite number of geometry may be devised by those skilled in the art. One example of a reflective surface and strobe lamp 326 is disclosed in U.S. Pat. No. 5,347,259, issued Sep. 13, 1994, to Mark Jongewaard, and is hereby incorporated by reference.

The reflector 220 has a notch 420 projecting from the second surface 322 into the first side 402. The menu 110 is disposed about the notch 420 in a manner that allows the indicating needle 112 to point to one of a number of specific indicia comprising menu 110 (i.e., the indicating needle 112 points to a menu selection). In one embodiment of the present invention, the menu 110 is a label comprising indicia representing 15, 30, 75 and 110 candela intensities. The menu 110 alternately may be embossed, imprinted, molded or otherwise denoted on the first side 402 of the reflector 220. Alternate menu 110 locations include other reflector 220 locations, the lens 102, the cover 104, the mounting plate 106 or other location which can be seen by an observer inspecting the strobe alarm 100.

The standoffs 226 interface with the second surface 322 of the reflector 220 to maintain the base 224 at a fixed relation to the reflector 220. In one embodiment, the standoffs 226 are integral to the reflector 220, each standoff 226 comprising a center tube 422 having an internal passage 327 (shown in FIG. 3) separating two flexible locking members 424. The internal passage 327 accommodates electrical connection of the strobe lamp 326 disposed in the receptors 324 on the reflector 220 and a control circuit denoted as CIR.

The base 224 generally comprises a selector switch (for example, a four position switch 228) and the control circuit CIR. Typically, the base 224 comprises a printed circuit board that contains some or all of the control circuit CIR. Optionally, the control circuit CIR may be located remotely from the base 224. One example of a control circuit is disclosed in the commonly assigned patent application entitled "Multi-Candela Alarm Unit", Ser. No. 09/449,276 filed simultaneously herewith, and is hereby incorporated by reference in its entirety. The control circuit CIR is coupled to the conductors that pass through the mounting plate 106. The base 224 is generally rectangular in form, having a first side 430, a second side 432, a third side 434, and a fourth side 436. The first side 430 of the base 224 is disposed on the same side of the strobe assembly 108 relative the first side 402 of the reflector 220. The base 224 additionally comprises a number of apertures 438 (only one of which is shown in FIG. 4) for receiving the locking members 424. The locking members 424 pass through the apertures 438 and engage the base 224, thus retaining the base 224 to the reflector 220.

The four position switch 228 is mounted proximate to the first side of the base 224 and is coupled to the control circuit CIR. The four position switch 228 has a slide selector 331 positioned facing the second surface 322 of the reflector 220. Each position of the slide selector 228 causes the control circuit CIR to actuate the strobe lamp 326 with a predetermined intensity. In one embodiment, the slide selector 331 positions correspond to strobe lamp 326 intensities of 15, 30, 75 and 110 candela. One skilled in the art will be able to devise varied embodiments of the invention comprising alternates intensities, strobe characteristics or other warning signal attributes through the use of the teachings herein.

Figure 5:
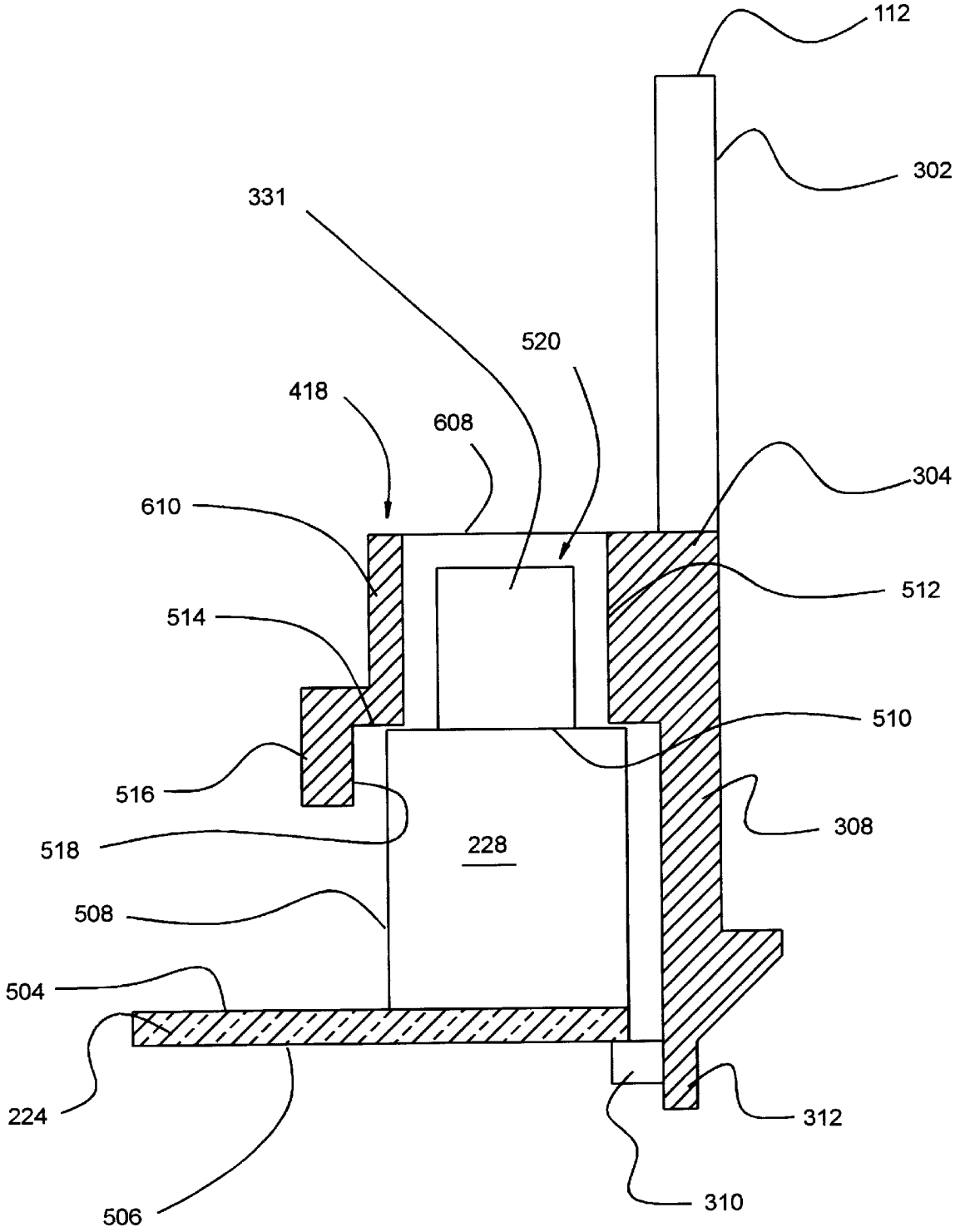
FIG. 5 is a partial detail of the strobe assembly of FIG. 2 illustrating an interface between the actuator and a selector switch.
Figure 6:
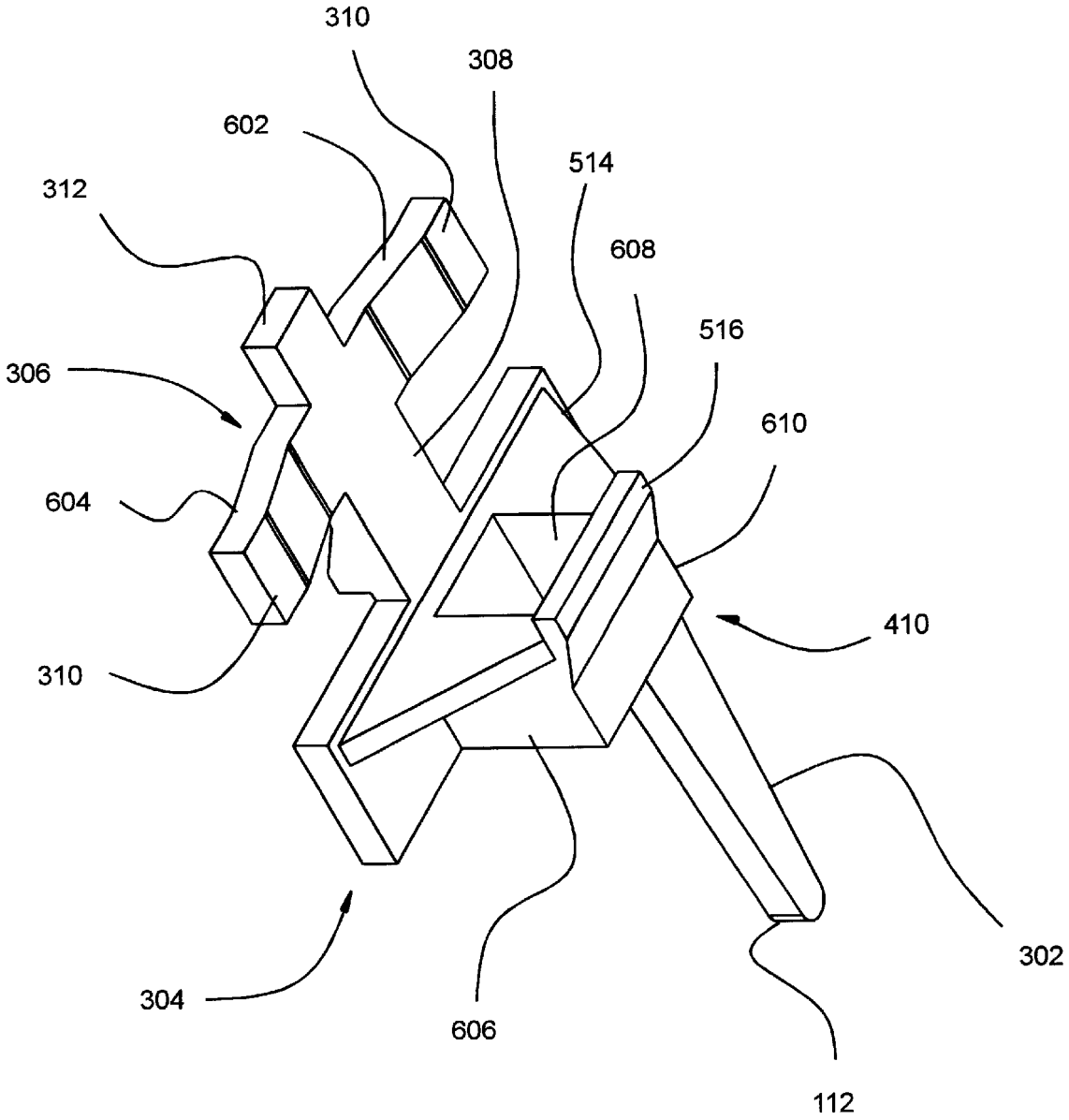
FIG. 6 is an isometric view of an actuator of the strobe assembly of FIG. 2; and, FIG. 7 depicts a simplified isometric view of an alternate embodiment of a strobe alarm having an audio warning.

Referring to FIG. 5 and 6, the actuator 230 has a first guide 304 and a second guide 306 connected by a center member 308. The first guide 304 has an indicator arm 302 that connects the indicating needle 112 to the first guide 304. The first guide 304 additionally comprises a first wall 606, a second wall 608, and a third wall 610. The first wall 606 and the second wall 608 extend from the first guide 304, and are connected by the third wall 610 to define a retaining collar 410. The retaining collar 410 has a surface 514 that banks against a side 510 of the four position switch 228. The retaining collar 410 surrounds the slide selector 430 so that the translational motion of the actuator 230 is duplicated by the slide selector 331.

The first guide 304 additionally has a retaining member 516 disposed proximate to the third wall 610. The retaining member 516 has an inner surface 518 that banks against a side 508 of the four position switch 228 opposite the first guide 304.

The second guide 306 comprises a tab 312, a first resilient member 602 and a second resilient member 604. The first resilient member 602 and the second resilient member 604 extend outwardly, and terminate in a retaining pad 310. The tab 312 extends perpendicularly from the first resilient member 602 and second resilient member 604. The tab 312 provides a point from with the actuator 230 may be engaged by an installer to change the switch selection. The first and second resilient members (602 and 604) are generally curved in shape such that it positions the retaining pads 310 under the base 224. The center member 308 is sized so that the surface 514 of the retaining collar 410 banks against the four position switch 228 while the retaining pads 310 snap under the base 224 to retain the actuator 230 in a position engaging the four position switch 228.

Referring to FIG. 2 and FIG. 3, in operation, the strobe alarm 100 provides a selectable strobe intensity selection. The strobe alarm 100 is installed by first securing the mounting plate 106 to backbox using fasteners (not shown) passing through the holes 210. The conductors are fed through the mounting plate 106 and secured to the terminal.

The strobe intensity of the strobe assembly 108 is then selected by an installer based on the applicable regulatory rules for the designated location. Once the proper intensity is determined, the strobe assembly 108 is set to that intensity by moving the actuator 230 as depicted by arrow 314 until the indicating needle 112 points at the desired intensity setting displayed on the menu 110. Since the actuator 230 moves the slide actuator 430 in concert with the indicating needle 112, the four position switch 228 is correspondingly set to select the proper intensity of the control circuit CIR.

Once the strobe intensity is set, the strobe assembly 108 is inserted into the lens 102 that has been snapped to the cover 104. In one embodiment, the strobe assembly 108 snaps into the cover 104, allowing the indicating needle 112 and menu 110 to be visible through the lens. The control circuit CIR is coupled to the appropriate conductor. The cover 104, now containing both the strobe assembly 108 and lens 102, is secured to the mounting plate 106 using the fastener 206.

The strobe alarm 100, now mounted to the wall, has the strobe intensity identifiable upon inspection as the indicating needle 112 is pointing to the menu selection corresponding to the set intensity. Upon the activation of the strobe alarm 100 by a triggering event, the strobe alarm 100 causes the strobe lamp to flash with an intensity corresponding to the slide switch position as indicated by the indicating needle 112.

Figure 7:
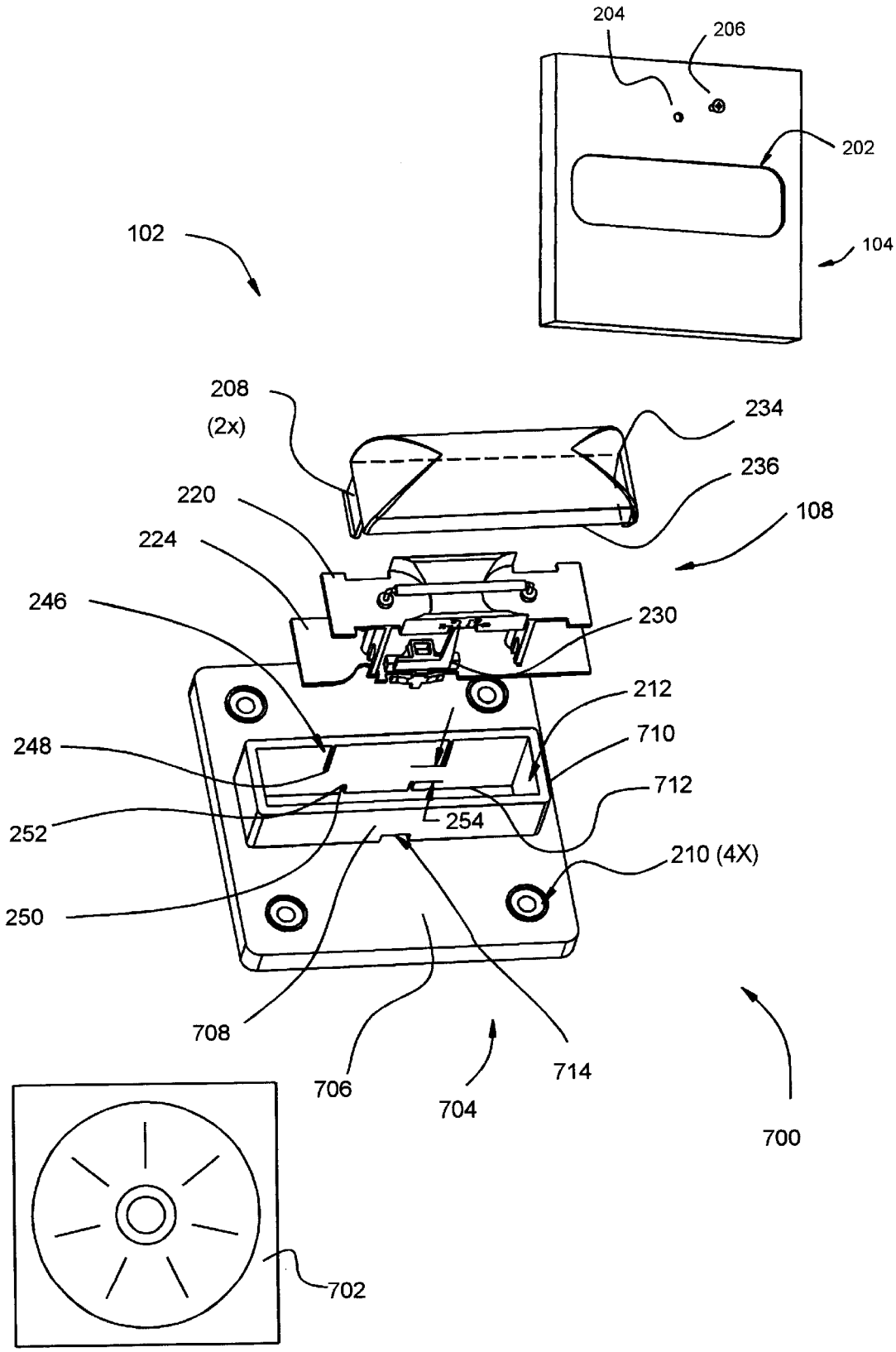

FIG. 7 depicts an exploded view of an alternate embodiment of a strobe alarm 700 having an audio warning device, e.g., speaker, buzzer, horn, bell or other audible signal. The audio warning is generally sounded by a speaker 702 coupled to the control circuit CIR. The speaker 702 is mounted to the mounting plate 704 below the strobe assembly 108. The mounting plate 704 comprises a base 706 and a generally rectangular boss 708. The boss 708 accepts a lens 102 in a terminal end 710 and the strobe assembly 108 in an open end 712. The boss 708 has a window 714 disposed in the boss 708 proximate to the base 706 through which an actuator 230 of the strobe assembly 108 may be manipulated.

Once the strobe intensity setting is selected by moving the actuator 230, a cover 104 is disposed over the mounting plate 106 and secured with a fastener. The cover 104 is designed such that it covers the window 714, thereby preventing access to the actuator 230 or switch 228 after the strobe alarm 700 is installed. The intensity setting of the strobe alarm 700 is identifiable to an observer as an indicating needle 112 of the actuator 230 is visible through the lens 102 pointing to a selection on a menu 110 disposed on a reflector 220 of the strobe assembly 108.

Although the present invention is disclosed illustratively strobe alarm having selectable intensity, the invention may be practiced in other alarm devises. For example, a strobe alarm having selectable intensity utilized in concert with other warning devices such as horns, bells and voice signals. As such, those skilled in the arts may devise variations of the inventive alarm by utilizing the teachings disclosed herein without departing from the spirit of the invention.

What is claimed is:

1. A strobe alarm comprising:

a housing;

a menu having a plurality of selections indicative of a plurality of strobe intensity settings; and an actuator having an indicator that indicates a selection of said menu, where said indicated selection is visible on said housing of said strobe alarm.

2. The strobe alarm of claim 1 further comprising a selector switch coupled to said actuator.

3. The strobe alarm of claim 2, wherein said selector switch comprises a plurality of switch positions, wherein each of said switch positions corresponds to one of said strobe intensity settings.

4. The strobe alarm of claim 3, wherein said plurality of selector switch positions are four.

5. The strobe alarm of claim 2, wherein said strobe intensity settings comprise 15, 30, 75 and 110 candela.

6. The strobe alarm of claim 2, wherein said housing further comprises:

a lens, wherein said menu is visible through said lens.

7. The strobe alarm of claim 2, wherein said housing further comprises:

a cover; and a lens projecting from said cover, wherein said cover, said lens, or said cover and lens encase said actuator.

8. The strobe alarm of claim 2 further comprising an audio warning device.

9. The strobe alarm of claim 1, wherein the menu is disposed upon a lens.

10. The strobe alarm of claim 1, wherein the menu is disposed upon a cover.

11. The strobe alarm of claim 1, wherein the menu is disposed upon a mounting plate.

12. The strobe alarm of claim 1, wherein the menu is disposed upon a reflector.

13. The strobe alarm of claim 1 further comprising a reflector, wherein said menu is disposed upon a side of said reflector.

14. The strobe alarm of claim 2, wherein the actuator further comprises:

a first guide coupled to said indicator;

a second guide; and a center member connecting said first guide and said second guide.

15. The strobe alarm of claim 14, wherein the first guide further comprises:

a retaining collar engaging said selector switch.

16. The strobe alarm of claim 14, wherein the second guide further comprises:

a first resilient member and a second resilient member that retain said actuator to said selector switch.

17. A strobe alarm comprising:

a cover;

a lens projecting from said cover;

a menu having a plurality of selections indicative of a plurality of strobe intensity settings;

a strobe assembly partially disposed within said lens, said strobe assembly comprising:

an actuator having an indicator which points to a selection of said menu, said indicator being visible through said lens; and a selector switch coupled to said actuator, said selector switch having a plurality of switch positions, each of said switch positions corresponding to one of said strobe intensity settings.

18. The strobe alarm of claim 17, wherein the menu is disposed upon a reflector, a lens, a cover, or a mounting plate.

19. The strobe alarm of claim 17, wherein said plurality of selector switch positions are four.

20. The strobe alarm of claim 18, wherein the actuator further comprises:

a first guide coupled to said indicator, said first guide having retaining collar engaging said selector switch;

a second guide having a first resilient member and a second resilient member, said first resilient member and said second resilient member retaining said actuator to said selector switch; and, a center member connecting said first guide and said second guide.

21. The strobe alarm of claim 18 further comprising an audio warning.

22. The strobe alarm of claim 18, wherein the mounting plate further comprises:

an outstanding base deposed between said lens to said mounting plate, said outstanding base having a window through which said actuator is accessible.

23. The strobe alarm of claim 22, wherein the window is covered by said cover.

* * * * *